US005493834A

United States Patent [19]

Nelson

[11] Patent Number: 5,493,834

[45] Date of Patent: Feb. 27, 1996

[54] BUILDING STRUCTURES, METHODS OF CONSTRUCTION, AND WALL FRAMING SECTION THEREFOR

[75] Inventor: Thomas E. Nelson, Chesterfield, Mo.

[73] Assignee: MiTek Holdings, Inc., Wilmington, Del.

[21] Appl. No.: 228,026

[22] Filed: Apr. 15, 1994

[51] Int. Cl.[6] ..... E04B 2/60

[52] U.S. Cl. ..... 52/349; 52/274; 52/481.1; 52/653.1

[58] Field of Search ..... 52/93.1, 281, 289, 52/431.1, 731.4, 731.5, 731.7, 731.9, 293.1, 293.3, 294, 241, 348, 349, 656.1, 264, 274, 296

[56] References Cited

U.S. PATENT DOCUMENTS

| | | | |
|---|---|---|---|
| Re. 28,976 | 9/1976 | Zinn | 52/481.1 X |
| Re. 29,412 | 9/1977 | Zinn | 52/731.9 X |
| Re. 29,965 | 4/1979 | Zinn | 52/481.1 X |
| 1,963,416 | 6/1934 | Minshall | 52/731.7 X |
| 2,052,033 | 8/1936 | Peck et al. | 189/85 |
| 2,200,636 | 5/1940 | Palmer | 189/1 |
| 2,574,074 | 11/1951 | Vogel | 189/1 |
| 3,245,185 | 4/1966 | Rowe | 52/293.3 X |
| 3,305,993 | 2/1967 | Nelsson | 52/241 |
| 3,601,942 | 8/1971 | Wilson | 52/300 |
| 3,611,653 | 10/1971 | Zinn | 52/481.1 X |
| 3,623,288 | 11/1971 | Horowitz | 52/264 |
| 3,841,043 | 10/1974 | Zinn | 52/481.1 X |
| 3,893,271 | 7/1975 | Kotlarz | 52/293.3 X |
| 3,925,875 | 12/1975 | Doke | 52/241 X |
| 4,194,336 | 3/1980 | Weinmar | 52/481.1 |
| 4,432,176 | 2/1984 | Balzer | 52/293 |
| 4,569,173 | 2/1986 | Hultquist | 52/293 |
| 4,612,744 | 9/1986 | Shamash | 52/220 |
| 4,619,098 | 10/1986 | Taylor | 52/738 |
| 4,837,988 | 6/1989 | Menchetti et al. | 52/36 |
| 4,858,407 | 8/1989 | Smolik | 52/481 |
| 4,987,719 | 1/1991 | Goodson, Jr. | 52/348 X |

FOREIGN PATENT DOCUMENTS

| | | | |
|---|---|---|---|
| 960014 | 12/1974 | Canada | 52/481.1 |
| 356059926 | 5/1981 | Japan | 52/293.1 |
| 599520 | 3/1948 | United Kingdom | 52/281 |
| 657061 | 9/1951 | United Kingdom | 52/293.1 |
| 2228752 | 9/1990 | United Kingdom | 52/731.7 |

*Primary Examiner*—Carl D. Friedman
*Assistant Examiner*—Yvonne Horton-Richardson
*Attorney, Agent, or Firm*—Senninger, Powers, Leavitt & Roedel

[57] ABSTRACT

A building structure including a metal wall framing section extending upwardly from a margin of a poured concrete slab having a footing, the framing section comprising sheet metal stud members extending between sheet metal top and bottom tracks, the bottom track being of L-shape in transverse section and constituting a form for the pouring of the margin of the slab and the footing, the stud members having holes adjacent their lower ends receiving a reinforcing bar for the foundation structure; the disclosure including the framing section per se, and a method of erecting a building utilizing the framing section.

17 Claims, 7 Drawing Sheets

1A
1A
45
25
27
45
45
25
45
5
23
35
23
35
23
35
23
35
37
37
37
37
31
6
6
3
59
55
55
65
55
65
55
21
33
3

187
181
177
135
105
191
123
179
145
193
199
103
153
203
195
109
165
197
121
107
161
131
161
173
111
175
163
171
117
167
133
169

BUILDING STRUCTURES, METHODS OF CONSTRUCTION, AND WALL FRAMING SECTION THEREFOR

BRIEF SUMMARY OF THE INVENTION

This invention relates to building structures, methods of construction of the building structures, and wall framing sections for said structures and methods, more particularly to building structures comprising a metal wall framing section on a poured concrete foundation, methods of constructing such structures, and metal wall framing sections used in said structures and methods.

The invention may be regarded as involving improvements on a present type of building construction comprising a metal wall framing section having top and bottom members, which may be referred to as top and bottom tracks, each formed of sheet metal of channel shape in transverse cross section, and studs each comprising a sheet metal channel spaced at intervals along the length of the top and bottom members and extending between the latter, each stud having its upper end extending into the top channel or track and fastened thereto, and having its lower end extending into the bottom channel or track and fastened thereto. As used in building construction, metal wall framing sections as above described are generally erected on a pre-poured concrete foundation structure comprising a margin of a pre-poured slab and a footing being pre-poured with the slab, with the web of the bottom channel bearing on the foundation structure. Anchor bolts, pre-installed in the foundation structure (i.e., set in place before the footing and slab are poured), are provided for holding down the wall section, these bolts (generally spaced on four foot centers and within ten inches of corners) extending up from the top of the foundation structure through bolt holes provided in the web of the bottom channel. Nuts are threaded down on the bolts against the top of the web of the bottom channel to anchor the bottom channel down on the foundation structure. This provides some measure of resistance to lift of the wall framing section off the foundation structure due, for example, to the force of wind on the roof of the building structure. The highest resistance may be attained by having the anchor bolts closely adjacent the studs, but this ideal location cannot be achieved in many instances because of variations in layout of the studs vis-a-vis the preset location in the foundation structure of the bolts, noting that the bolts seldom fall at the ideal locations. The bottom channel and the studs may be subject to distortion due to wind lift, causing extensive damage (though perhaps not total failure) of the building. An additional problem is involved in that a number of bolts may fall at the location of a web of a stud, and the workman doing the framing usually cuts out the web of the stud for clearance, undesirably reducing the load-bearing capacity of the stud. Still a further problem (and a major problem) is involved in the above-noted prior art construction in that the framers often cut away large areas of the bottom channel to provide clearance for plumbing (pipes), and this can seriously weaken the wall framing section and leave large unsupported areas for the lower edge of dry wall which is subsequently applied to the inside of the wall framing section.

The invention may also be regarded as involving improvements on the metal building wall constructions disclosed in U.S. Pat. No. 2,200,636 issued May 14, 1940, which so far as known to applicant are not presently used, and which essentially involve a metal wall section comprising a flat plate having a corrugated plate secured on one face thereof forming hollow cells through which a reinforcing bar is passed after being positioned in or on a concrete foundation block prior to pouring concrete.

Among the several objects of this invention may be noted the provision of a building structure comprising a metal wall framing section of open construction, comprising elongate top and bottom members and stud members extending between said top and bottom members, the wall framing section extending upwardly from a poured concrete foundation structure, in which the bottom member of the wall framing section as fabricated comprises a form for the pouring of the concrete to form the foundation structure, and in which the wall framing section is effectively anchored in the foundation structure; the provision of such a building structure in which the foundation structure has reinforcement therein and the wall framing section is effectively tied down to the reinforcement; the provision of a metal wall framing section adapted to be erected in situ and to have the concrete for the foundation structure poured in place at the bottom of the section and to be formed into the foundation structure by the bottom member of the wall framing section, with reinforcement for the foundation structure embedded therein and with the wall framing section anchored in the foundation structure by the reinforcement; and the provision of an economical method of constructing a building using a wall framing section of the invention.

In general, a building structure of this invention comprises a poured concrete foundation structure and a metal wall framing section extending upwardly from the foundation structure. The metal wall framing section comprises an elongate top member, an elongate bottom member and a plurality of stud members extending between the top and bottom members parallel to one another spaced at intervals along the length of the top and bottom members. Each of the top, bottom and stud members is formed of sheet metal. The bottom member is of L-shape in transverse section thereby having a vertical leg and a horizontal leg. Each stud member is fastened at its upper end to the top member and extends down on the inside of the vertical leg of the bottom member and is fastened to the bottom member. Each stud member is of such shape in transverse cross section as to have a web in a plane transverse to the top and bottom members and means for stiffening the web, and has a hole in the web thereof adjacent its lower end on an axis generally parallel to the top and bottom members and below the upper edge of the vertical leg of the bottom member. The holes in the webs of the stud members are aligned. An elongate reinforcing member for the foundation structure extends through the holes. The lower ends of the stud members and the reinforcing member are embedded in the concrete of the foundation structure, the bottom member constituting a form for pouring of the foundation structure, the latter structure having an outside face formed against and in face-to-face engagement with the inside face of vertical leg of the bottom member and a bottom formed against and in face-to-face engagement with the top face of the horizontal leg of the bottom member.

A metal wall framing section of the invention generally comprises per se an elongate top member, an elongate bottom member and a plurality of stud members extending between the top and bottom members parallel to one another spaced at intervals along the length of the top and bottom members. Each of the top, bottom and stud members is formed of sheet metal. The bottom member is of L-shape in transverse section thereby having a vertical leg and a horizontal leg. Each stud member is fastened at its upper end to the top member and extends down on the inside of the vertical leg of the bottom member and is fastened to the bottom member. Each stud member is of such shape in transverse cross section as to have a web in a plane transverse to the top and bottom members and means for stiffening the web, each stud member having a hole in the web thereof adjacent its lower end on an axis generally parallel to the top and bottom members and below the upper edge of the vertical leg of the bottom member. The holes in the stud members are aligned for the reception of an elongate reinforcing member, said bottom member constituting a form for the pouring of concrete to form a foundation structure for the metal wall framing section, the lower ends of the stud members and the reinforcing member becoming embedded in the concrete.

The method of this invention of constructing a building generally comprises threading a reinforcing bar through the holes in the stud members of a metal wall framing section as set forth above, erecting the section in situ, and pouring concrete around the lower ends of the stud members and the reinforcing bar utilizing the bottom member as a form to form a concrete foundation structure for the wall framing section, the concrete setting with the lower ends of the stud members and the reinforcing bar embedded therein.

Other objects and features will be in part apparent and in part pointed out hereinafter.

BRIEF DESCRIPTION OF THE DRAWINGS

Corresponding reference characters indicate corresponding parts through several view of the drawings.

DETAILED DESCRIPTION

Figure 5:
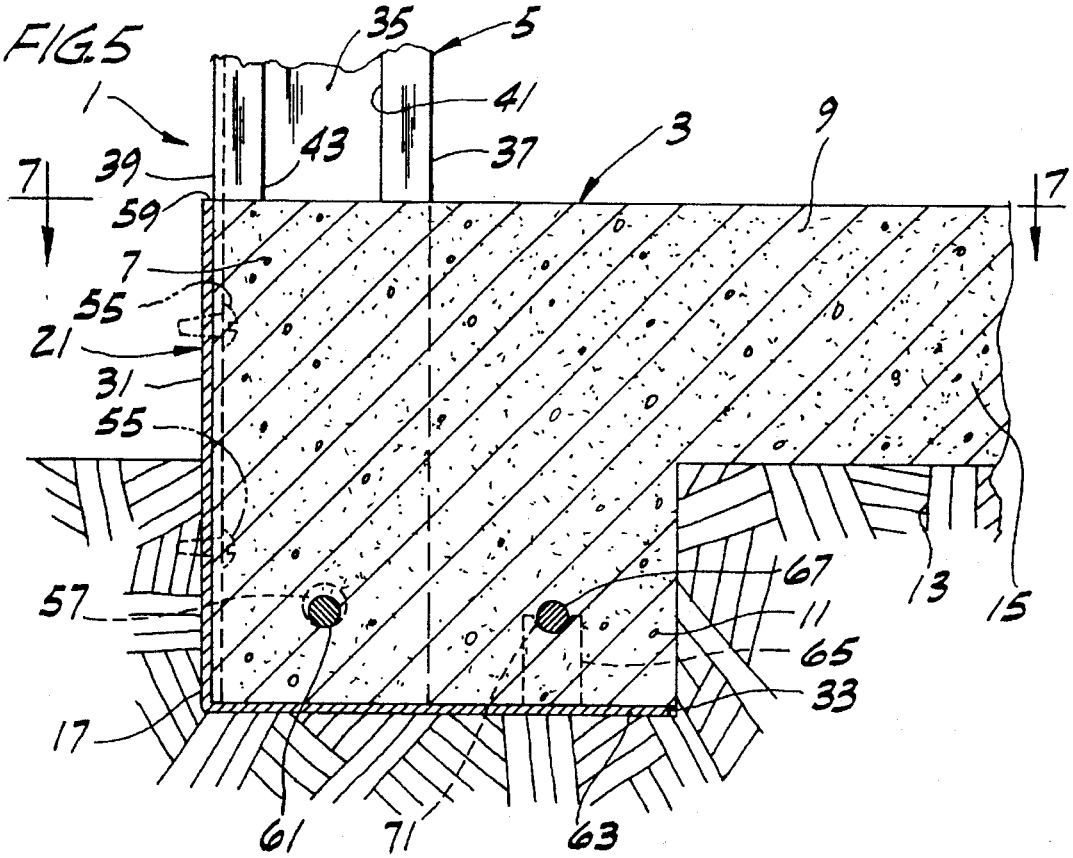
FIG. 5 is view similar to FIG. 3 showing the concrete poured to form the slab and footing and showing the lower ends of stud members of the wall framing section and the reinforcing bars embedded in the concrete.
Figure 6:
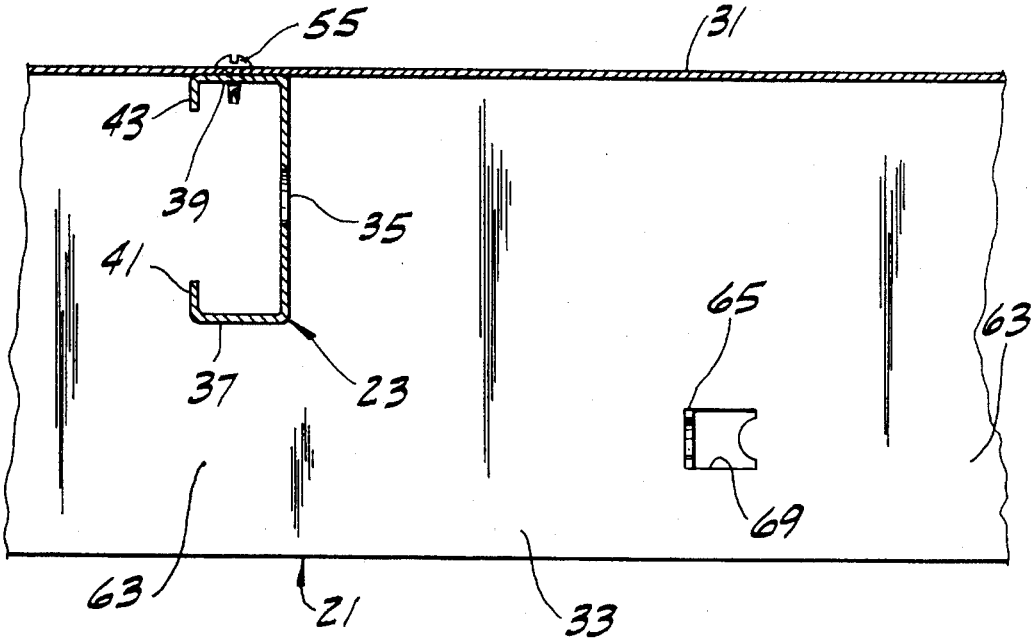
FIG. 6 is an enlarged horizontal section on line 6—6 of FIG. 1.
Figure 7:
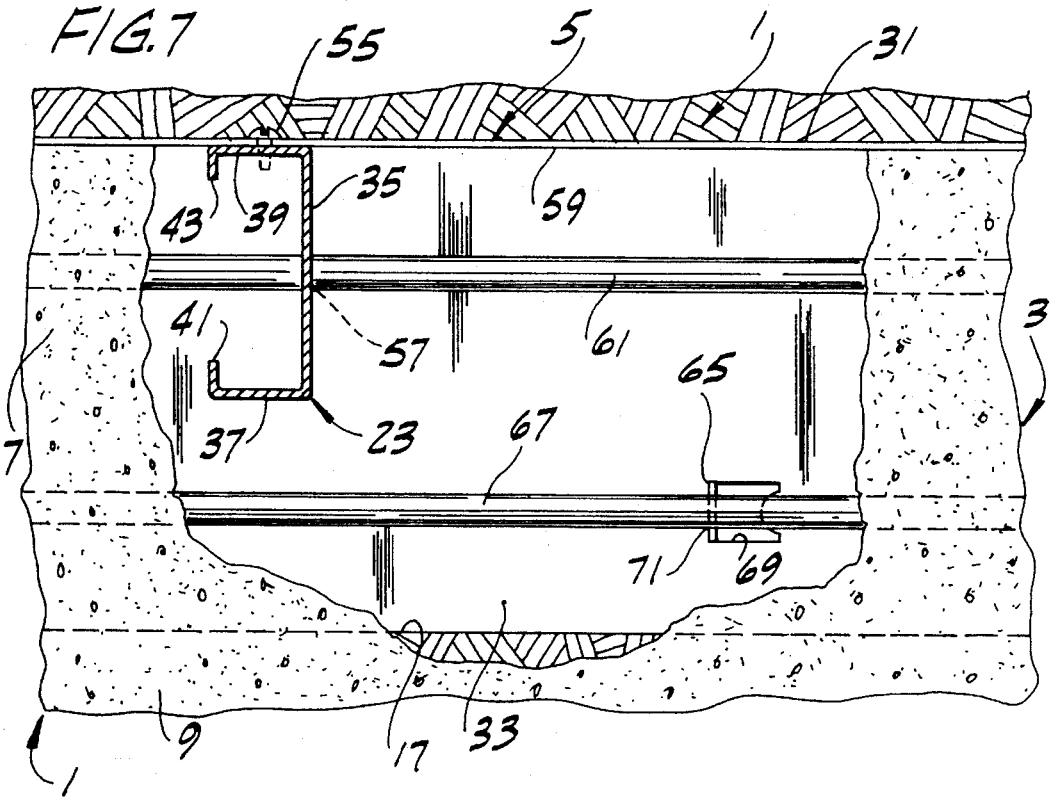
FIG. 7 is a horizontal section on line 7—7 of FIG. 5 with concrete broken away to show the reinforcing bars.

Referring to the drawings, a first version of the building structure of this invention, indicated at 1 in FIGS. 5 and 7, is shown to comprise a poured concrete foundation structure 3, and a metal wall framing section 5 extending upwardly from this foundation structure. As shown in FIG. 5, concrete foundation structure 3 comprises a margin 7 of a poured concrete slab 9 and a footing 11 at the margin of the slab. In constructing a building, the ground 13 is prepared for the pouring of the slab, the surface on which the slab is poured being indicated at 15. A trench 17 is dug in the ground at a side of the area of the ground on which the slab is to be poured to a depth generally corresponding to the height of the footing portion 11 of the foundation structure 3. By way of example, the slab may be four inches thick and the foundation structure (margin of the slab plus the footing) eight inches high, the trench being four inches deep.

Figure 1:
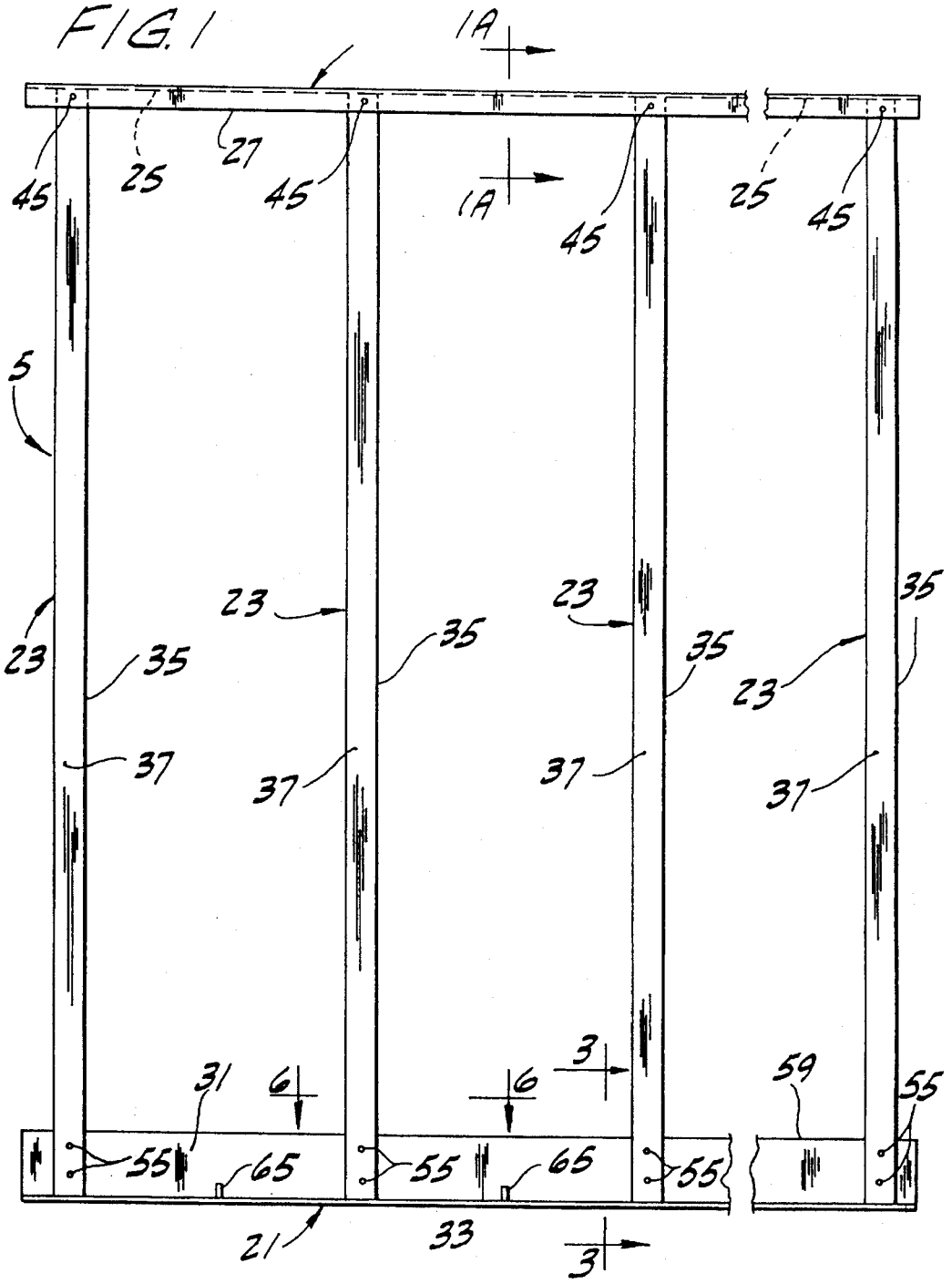
FIG. 1 is view in elevation, with parts broken away to reduce the length of the view, of that side of a metal wall framing section of this invention constituting its inside as it is used in constructing a building.
Figure 1A:
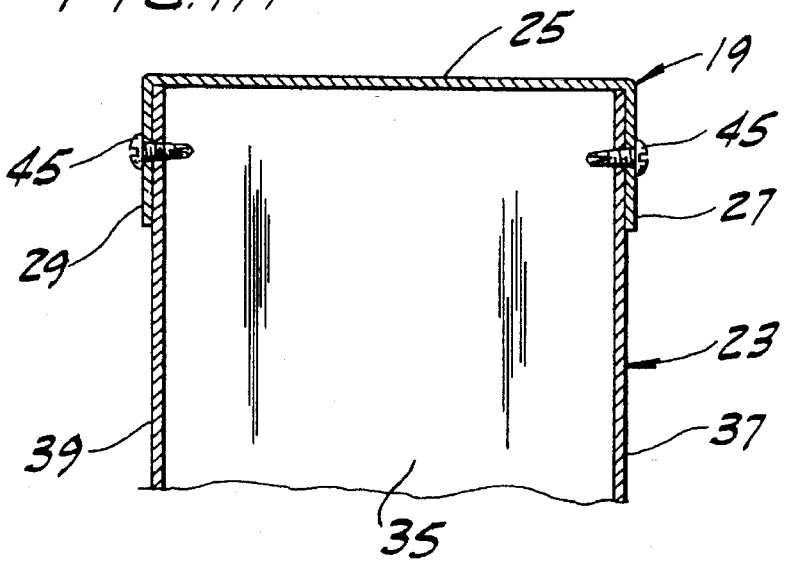
FIG. 1A is an enlarged vertical transverse section on line 1A—1A of FIG. 1.

The metal wall framing section 5 comprises an elongate top member or track 19, an elongate bottom member or track 21 and a plurality of stud members each designated 23 extending between the top and bottom members parallel to one another spaced at intervals along the length of the top and bottom members. Each of the top, bottom and stud members is formed of sheet metal, generally sheet steel. As shown in FIG. 1A the top member 19 is formed of channel shape in transverse cross section, having a web 25 and inside and outside flanges 27 and 29 extending down from the web in the erected vertical position of the framing section 5. The term "inside" refers to that side of the framing section which is on the inside of the building erected using the framing section; the term "outside" refers to the other side of the framing section. The bottom member 21 is formed of L-shape in transverse cross section thereby having legs 31 and 33 at right angles to one another, the leg 31 being vertical and the leg 33 being horizontal in the erected (vertical) position of the framing section 5. The vertical leg 31 of the bottom member 21 is generally coplanar with the outside flange 29 of the top member 19. Each of the stud members 23 is of channel shape in cross section, thereby having a web 35 and inside and outside flanges 37 and 39 and further having inturned lips 41 and 43 at the free edges of the flanges for stiffening the web.

Figure 1B:
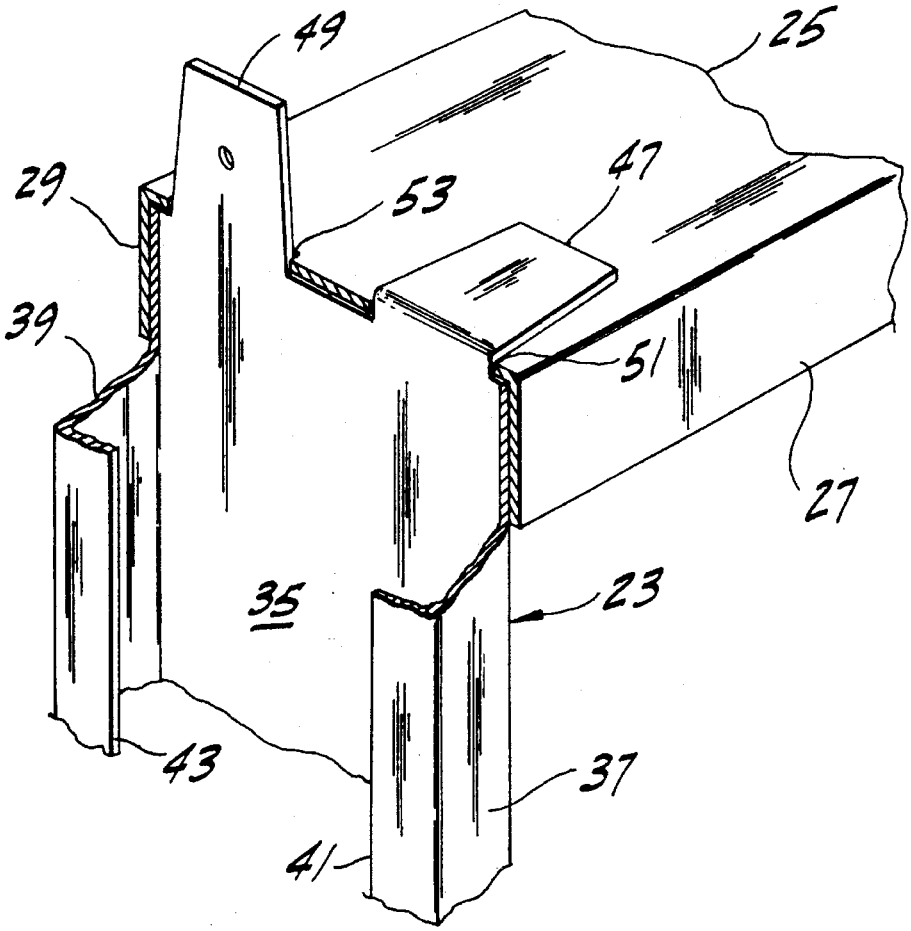
FIG. 1B is a perspective illustrating a modification.
Figure 2:
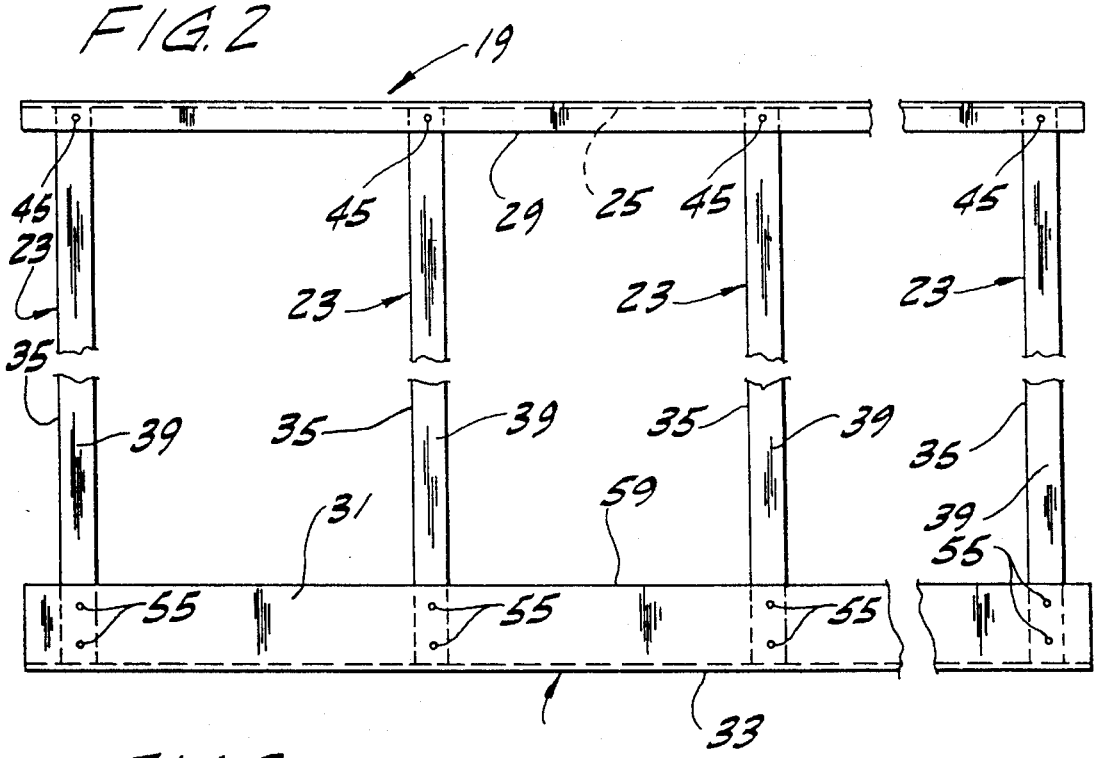
FIG. 2 is a view in elevation, with parts broken away to reduce both the length and height of the view, of the other side (the outside) of the metal wall framing section of FIG. 1.

Each stud member 23 has a width (the distance between the outside faces of its inside and outside flanges 37 and 39) corresponding generally to the distance between the inside faces of the flanges 27 and 29 of the channel-section top member 19. Each stud member 23 at its upper end extends up into the channel-section top member 19 with its web 35 in a plane transverse to the top member and with its flanges 37 and 39 engaging the flanges 27 and 29 of the top member 19 on the inside thereof, and is fastened to the top member in suitable manner. As shown in FIGS. 1, 1A and 2, this fastening may be by means of sheet metal screws as indicated at 45 driven from outside the flanges 27 and 29 of the top member into the flanges 37 and 39 of the stud member. Alternatively, as shown in FIG. 1B, each stud member 23 could be fastened to the top member 19 by having a pair of tabs 47 and 49 extending up from its upper end through slots at 51 and 53 in the web 25 of the top member, one of these tabs (e.g. tab 47) being bent over on top of the web of the top member and the other (49) being left extending up from the web of the top member for attachment thereto of roof structure such as a metal roof truss. The latter type of fastening is shown in my copending U.S. patent application Ser. No. 180,146 filed Jan. 11, 1994, entitled Metal Wall Framing, and reference may be made thereto for details.

Each stud member 23 at its lower end extends down on the inside of the vertical leg 31 of the bottom member 21, the outside flange 39 of the stud member engaging the inside face of the vertical leg. The horizontal leg 33 of the bottom member 21 is wider than the stud members and extends inwardly with respect to the wall framing section 5 under the lower ends of the stud members and beyond the vertical plane of the inside flanges 37 of the stud members. Each stud member is suitably fastened at its lower end to the bottom member as by means of sheet metal screws as indicated at 55 driven through the vertical leg 31 of the bottom member into the outside flange 39 of the stud member. Alternatively, each stud member could be fastened to the bottom member 21 by having a pair of tabs extending down from its lower end through slots in the horizontal leg 33 of the bottom member, both tabs being bent over on the bottom of the leg 33.

Each of the stud members 23 is provided with a hole 57 in its web 35 adjacent its lower end on an axis generally parallel to the top and bottom members 19 and 21 and below the upper edge 59 of the vertical leg 31 of the bottom member 21. The holes 57 in the stud members are aligned for the reception of an elongate reinforcing member, more particularly a steel reinforcing bar ("rebar") 61. The horizontal leg 33 of the bottom member or track 21, being wider than the stud members 23 has an inner portion 63 extending inwardly beyond the stud members, this portion having chairs 65 thereon for supporting a second reinforcing bar 67 extending parallel to the first bar 61 generally at the same elevation as the first bar 61 and spaced from the stud members 23 on the inside of the stud members. The chairs 65 are constituted by integral portions of the inner portion 63 of the horizontal leg 33 of the bottom member 21 struck up from said leg 33, leaving openings 69 in said leg. Each of the struck-up integral portions is in the form of a tab or tongue, having a notch 71 in its upper end for cradling the said second reinforcing bar 67.

Figure 3:
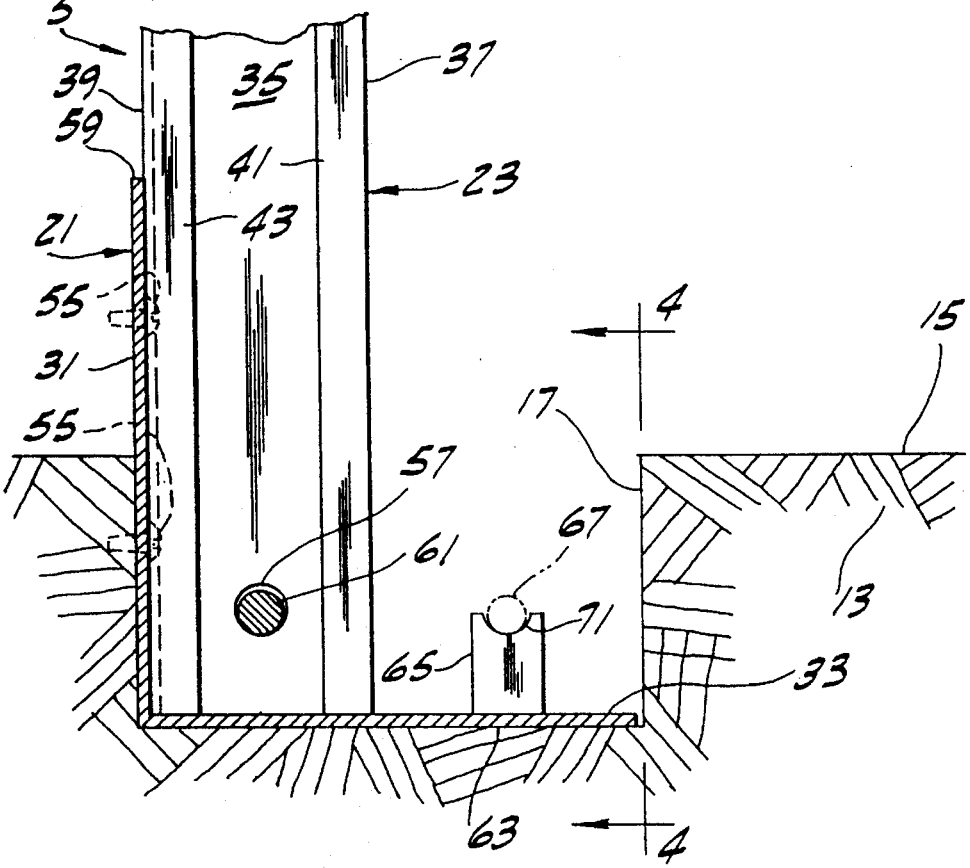
FIG. 3 is an enlarged vertical section on line 3—3 of FIG. 1 showing the bottom portion of the wall framing section positioned in a trench in the ground for the provision of reinforcing bars and the pouring of concrete to form a slab and a footing of a building structure of this invention.
Figure 4:
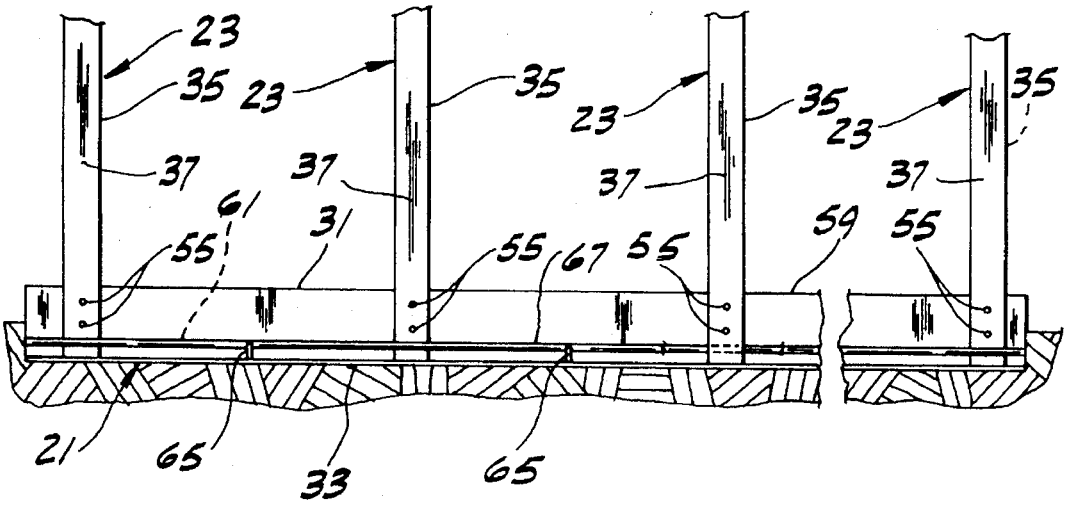
FIG. 4 is a view in section on line 4—4 of FIG. 3 and corresponding to the lower part of FIG. 1 and on the scale of FIG. 1 showing the reinforcing bars applied ready for the pouring of the concrete.

In constructing a building utilizing a wall framing section 5 of this invention, preparations are made for pouring the slab 9 and the footing 11 by preparing the ground and digging the trench 17. A reinforcing bar 61 is threaded through the holes 57 in the stud members 23 of a wall framing section 5 and the latter is then erected in situ with its bottom member or track 21 set in the trench, with the horizontal leg 33 of the bottom member bearing on the ground surface at the bottom of the trench and with the vertical leg 31 of the bottom member contiguous with respect to the outside of the trench (see FIG. 3). The second reinforcing bar 67 is seated on the chairs 65 in the trench. Then concrete is poured to form the slab 9 and the footing 11, being poured around reinforcing bars and around the lower ends of the stud members 23. The bottom member or track 21 is utilized as a form to form the margin of the slab 9 and the footing 11, the concrete being poured on the horizontal leg 33 at the bottom of the trench 17, filling the trench between the vertical leg 31 of member 21 and the opposite side of the trench, and being poured against the vertical leg 31 of member 21 generally up to the level of the upper edge 59 of the vertical leg 31 of member 21. The said upper edge 59 of the vertical leg 31 defines the level of the upper surface of the slab 9. The outside face of the foundation structure comprising the margin of the slab and the footing is formed against and in face-to-face engagement with the inside face of the vertical leg 31 of the bottom member 21 and the bottom of the footing 11 is formed against and in face-to-face engagement with the top face of the horizontal leg 33 of the member 21. The top face of the foundation structure (comprising the margin of the slab and the footing 11) and the top face of the body of the slab lie in a generally horizontal plane generally flush with the upper edge 59 of the vertical leg 31 of member 21. The reinforcing bars 61 and 67 are thus embedded in the concrete foundation structure comprising the margin of the slab 9 and the footing 11. The lower ends of the stub members 23 are also embedded in the concrete of the said foundation structure. The wall framing section 5 is anchored in the foundation structure by the reinforcing bar 61 extending through holes 57 in the stud members of the framing section.

Figure 8:
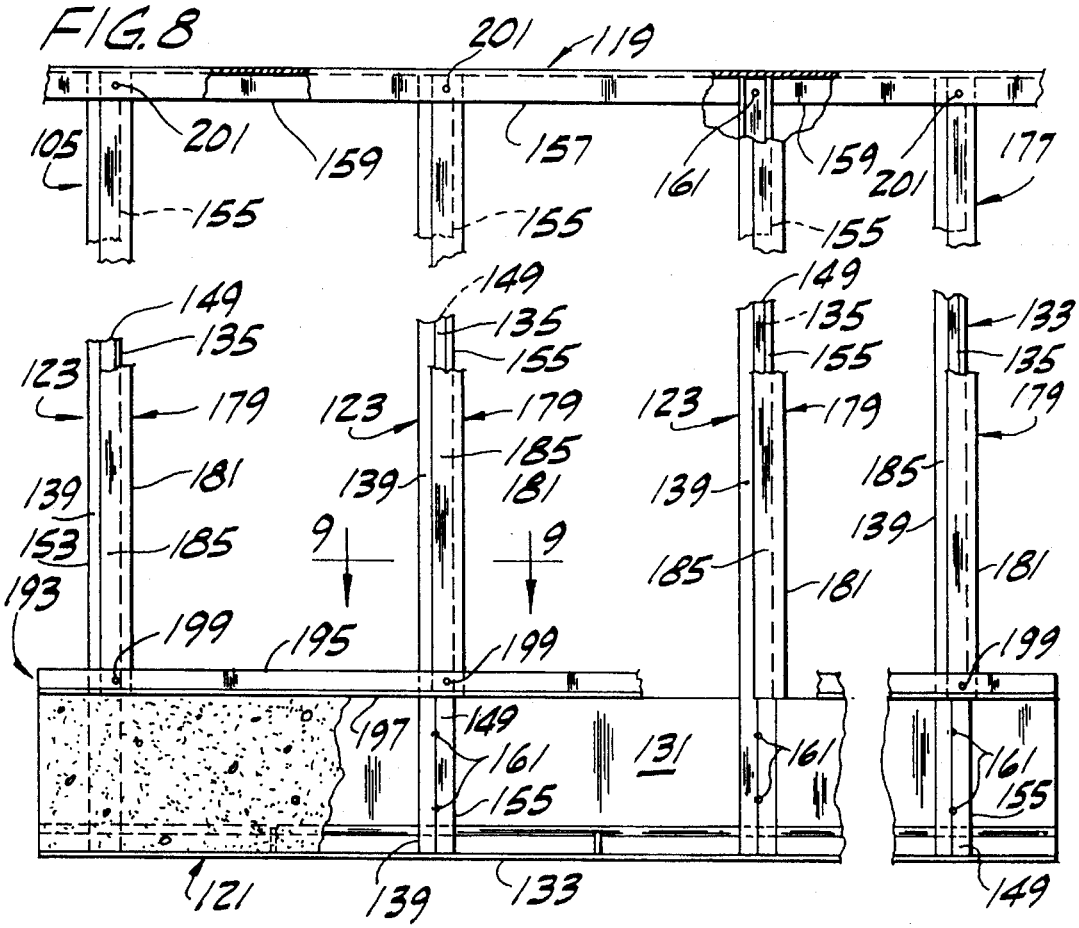
FIG. 8 is a view similar to FIG. 1 of a modification, showing a portion of the concrete which is poured to form the foundation structure.
Figure 9:
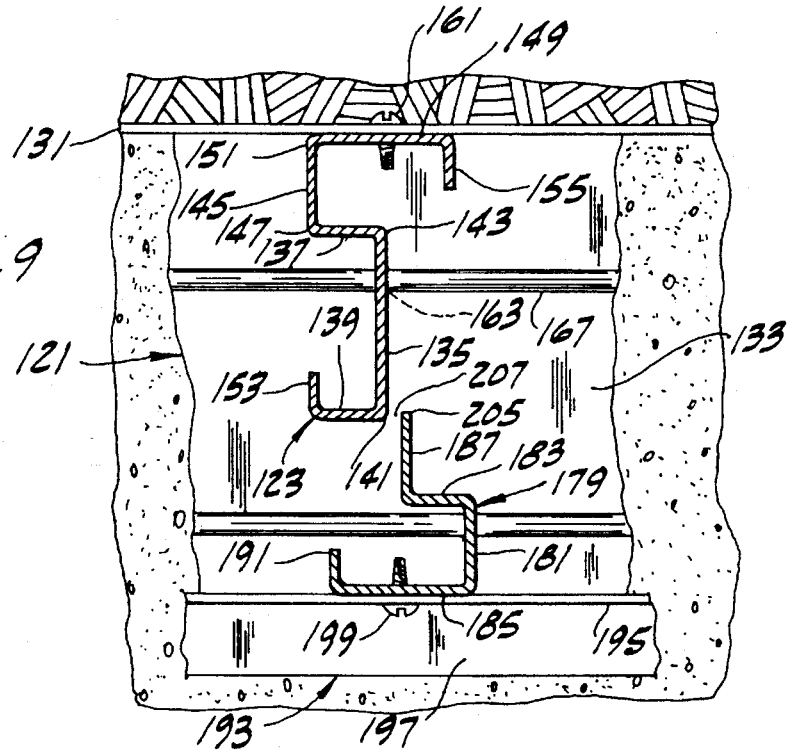
FIG. 9 is a view similar to FIG. 4 showing the FIG. 8 modification, and showing part of the poured concrete.
Figure 10:
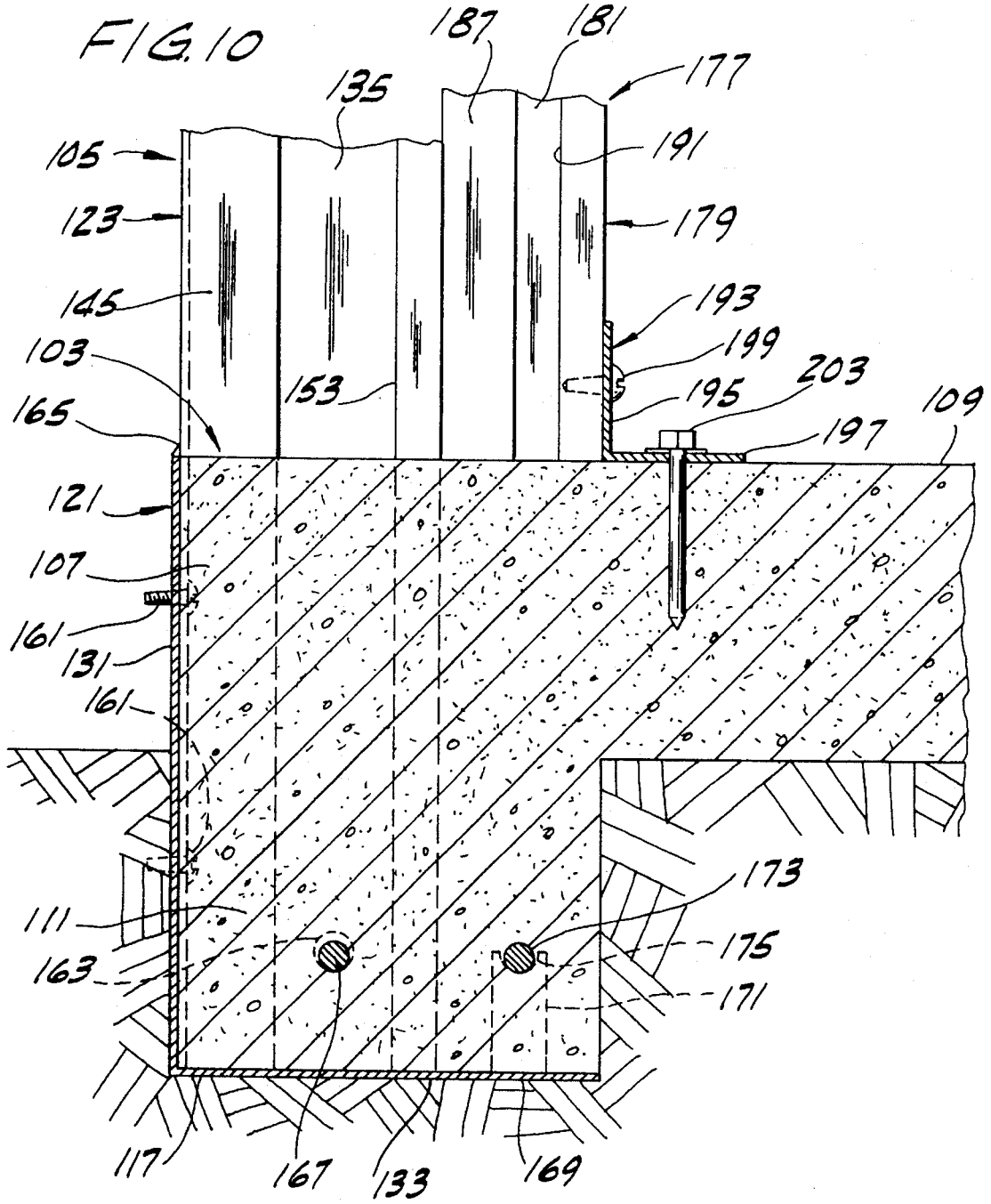
FIG. 10 is a view similar to FIG. 5 showing the FIG. 8 modification.

FIGS. 8–10 illustrate a modification of the building structure of this invention designated in its entirety as building structure 101 to distinguish it from the above-described building structure 1, wherein there is used a metal wall framing section designated in its entirety by the reference numeral 105 to distinguish it from the above-described metal farming section 5. Like building structure 1, the building structure 101 comprises a poured concrete foundation structure 103 comprising a margin 107 of a poured concrete slab 109 and a footing 111 at the margin of the slab. At 117 is indicated a trench corresponding to trench 17. The metal wall framing section 105 comprises an elongate top member or track 119 corresponding to member 19, an elongate bottom member or track 121, corresponding to member 21, and a plurality of stud members each designated 123 extending between the top and bottom members parallel to one another spaced at intervals along the length of the top and bottom members. Like members 19, 21 and 23, each of members 119, 121 and 123 is formed of sheet metal, generally sheet steel. The top member 119 is formed of channel shape in cross section like member 19 and the bottom member 119 is formed of L-shape in transverse cross-section having a horizontal leg 131 and a vertical leg 133 (like legs 31 and 33) of member 21. As shown in FIG. 9, each stud member 123 is formed with such a shape in cross-section as to have a first web 135 which extends in a vertical plane transverse to the top and bottom members, first and second flanges 137 and 139 extending at right angles to said first web 135 in one direction from the longitudinal edges 141 and 143 of the first web, a second web 145 extending laterally outwardly from the outer longitudinal edge 147 of the second flange, and a third flange 149 extending back at right angles to the said second web 145 from the outer longitudinal edge 151 of said second web. The flanges 137 and 149 have lips indicated at 153 and 155. Each of the stud members 123 has a total width (the distance between the outside faces of flanges 139 and 149, less than the distance between the inside faces of the flanges 157 and 159 of the top member 119. The stud members 123 are assembled with the top and bottom members extending between the top and bottom members, each stud member 123 extending into the channel-section top member with the outside face of the flange 149 engaged face-to-face with the inside face of the outside or exterior flange 159 of the top member at its upper end and with the outside face of its flange 149 engaged face-to-face with the inside face of the vertical leg 131 of the bottom member 121. The stud members are fastened at their upper and lower ends to the outside flange 159 of the top member 119 and the vertical leg 131 of the bottom member 121 as by self-tapping screws as indicated at 161 or by a tab and slot system as above described for the metal wall framing section 5. Thus, the stud members 123 are located toward the exterior or outside of the wall framing section 105 and are referred to as exterior stud members. Each of them has a hole 163 in the web 135 thereof adjacent its lower end, corresponding to the hole 57 in each stud member 23) on an axis generally parallel to the top and bottom members 119 and 121 and below the upper edge 165 of the vertical leg 131 of the bottom member. The holes 163 are aligned for the reception of a reinforcing bar 167 (corresponding to bar 61). The horizontal leg 133 of the bottom member or track is wider than the stud members 123 and has an inner portion 169 extending inwardly beyond the stud members. This portion has chairs 171 (corresponding to chairs 65) struck up from portion 169 of the horizontal leg 133 of the bottom member 121 for supporting a second reinforcing bar 173 (corresponding to bar 67) in notches 175 in the upper ends of the chairs.

In constructing a building using a wall framing section 105 as above described, a reinforcing bar 167 is threaded through the holes 163 in the stud members 123 of the wall framing section, and the latter is then erected in situ with its bottom member or track 121 set in trench 117 (corresponding to trench 17) with the horizontal leg 133 of the bottom member bearing on the ground surface at the bottom of the trench, and with the vertical leg 131 of the bottom member contiguous with respect to the outside of the trench (see FIG. 10). The second reinforcing bar 173 is seated on the chairs 171 in the trench. The concrete is then poured to form the slab 109 and the footing 111, being poured around the reinforcing bars and around the lower ends of the stud members 123. Here again the bottom member or track is utilized as a form to form the margin of the slab and the footing.

After the concrete has set, the wall framing section 105 is provided with a plurality of stud members 179 referred to as interior stud members each adjacent to a respective exterior stud member 123 and located inwardly thereof. Each interior stud member 179 is formed of sheet metal of such shape in cross-section as to have a first web 181 which extends in a vertical plane transverse to the top and bottom members, first and second flanges 183 and 185 extending at right angles to said first web in one direction from said first web, and a second web 187 extending laterally outwardly from the outer longitudinal edge 189 of the second flange. The flange 185 has a lip indicated at 191. Stud members or struts having the cross-sectional shape of the interior stud members 179 are disclosed in my aforesaid pending U.S. patent application Ser. No. 180,146.

Each interior stud member 179 has a length corresponding generally to the vertical distance from the bottom face of the web of the top member or track 119 and the top face of the slab 109. The interior stud members are assembled side-by-side spaced at stud intervals corresponding to the spacing of the exterior stud members 123 with an elongate foot 193 extending across the interior stud members adjacent their lower ends. The foot is of L-shape in transverse cross section thereby having a vertical leg 195 and a horizontal leg 197. The vertical leg of the foot is fastened to the interior stud members adjacent their lower ends as by means of self-tapping sheet metal screws such as indicated at 199 in FIGS. 8–10. The auxiliary frame 177 constituted by the assembly of the interior studs 179 and the foot 193 is assembled with the previously erected wall framing section 105 and the slab 109 by inserting the upper ends of the interior stud members 179 into the channel-section top member 119 with the outside faces of the flanges 185 of the interior stud members engaging the inside face of the inside flange 157 of the top member 119 and with the horizontal leg 197 of the L-shaped foot engaging the top of the slab 109. Then members 179 are fastened at their upper ends by the flange 157 as by self-tapping screws as indicated at 201 and the foot is fastened to the slab as by shooting fasteners 203 through the horizontal leg of the foot into the slab, thereby completing the building structure. The edge 205 of the web 187 is located adjacent but spaced from the edge 141 of the web 135 of stud member 123 so as to provide a thermal break 207 (see FIG. 9).

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A building structure comprising a poured concrete foundation structure and a metal wall framing section extending upwardly from the foundation structure, said metal wall framing section comprising an elongate top member, an elongate bottom member and a plurality of stud members extending between the top and bottom members parallel to one another spaced at intervals along the length of the top and bottom members, each of said top, bottom and stud members being formed of sheet metal, the bottom member being of L-shape in transverse section thereby having a vertical leg and a horizontal leg, each stud member being fastened at its upper end to the top member and extending down on the inside of the vertical leg of the bottom member and being fastened to the bottom member, the horizontal leg of the bottom member having a width substantially greater than the width of the stud members and thereby having an inner flat portion extending inwardly substantially beyond the stud members, each stud member being of such shape in transverse cross section as to have a web in a plane transverse to the top and bottom members and means for stiffening the web, each stud member having a hole in the web thereof adjacent its lower end on an axis generally parallel to the top and bottom members and below the upper edge of the vertical leg of the bottom member, the holes in the stud members being aligned, an elongate reinforcing member for the foundation structure extending through the holes, the lower ends of the stud members and the reinforcing member being embedded in the concrete of the foundation structure, the bottom member constituting a form for pouring of the foundation structure, the latter structure having an outside face formed against and in face-to-face engagement with the inside face of vertical leg of the bottom member and a bottom formed against and in face-to-face engagement with the top face of the horizontal leg of the bottom member.

2. A building structure as set forth in claim 1 including a concrete slab having an outer margin, wherein the foundation structure includes said outer margin of the concrete slab, said outer margin having a top face in a generally horizontal plane generally flush with the upper edge of the vertical leg of the bottom member.

3. A building structure as set forth in claim 1 wherein the reinforcing member comprises a reinforcing bar.

4. A building structure as set forth in claim 3 having a second reinforcing bar extending parallel to the first spaced from the stud members above said inner portion of said horizontal leg inwardly of the stud members.

5. A building structure as set forth in claim 4 wherein said inner portion of said horizontal leg has chairs thereon for supporting the second reinforcing bar.

6. A building structure as set forth in claim 5 wherein the chairs are constituted by integral portions of said inner portion of the horizontal leg struck up from the horizontal leg.

7. A building structure as set forth in claim 1 wherein the stud members with the holes therein are arranged to constitute exterior stud members toward the side of the wall framing section on the outside of the building structure, and wherein the wall framing section has interior stud members positioned inwardly of the exterior stud members, said interior stud members terminating at the top of the foundation structure, and an elongate foot extending across the interior stud members adjacent the lower ends of the interior stud members, said foot being fastened to the interior stud members and overlying and fastened to the top of the concrete foundation structure.

8. A building structure as set forth in claim 7 wherein the foot is of L-shape in transverse cross section thereby having a vertical leg and a horizontal leg, the vertical leg of the foot being fastened to the interior stud members adjacent their lower ends and the horizontal leg of the foot extending in the direction away from the exterior stud members and overlying and fastened to the top of the foundation structure.

9. A metal wall framing section comprising an elongate top member, an elongate bottom member and a plurality of stud members extending between the top and bottom members parallel to one another spaced at intervals along the length of the top and bottom members, each of said top, bottom and stud members being formed of sheet metal, the bottom member being of L-shape in transverse section thereby having a vertical leg and a horizontal leg, each stud member being fastened at its upper end to the top member and extending down on the inside of the vertical leg of the bottom member and being fastened to the bottom member, the horizontal leg of the bottom member having a width substantially greater than the width of the stud members and thereby having an inner flat portion extending inwardly substantially beyond the stud members, each stud member being of such shape in transverse cross section as to have a web in a plane transverse to the top and bottom members and means for stiffening the web, each stud member having a hole in the web thereof adjacent its lower end on an axis generally parallel to the top and bottom members and below the upper edge of the vertical leg of the bottom member, the holes in the stud members being aligned for the reception of an elongate reinforcing member, said bottom member constituting a form for the pouring of concrete to form a foundation structure for the metal wall framing section, the lower ends of the stud members and the reinforcing member becoming embedded in the concrete.

10. A metal wall framing section as set forth in claim 9 having means for supporting a second reinforcing member extending parallel to the first inwardly of the stud members.

11. A metal wall framing section as set forth in claim 10 wherein said supporting means comprises said inner portion of the horizontal leg of the bottom member and chairs on said inner portion of the horizontal leg.

12. A metal wall framing section as set forth in claim 11 wherein the chairs are constituted by integral portions of said inner portion of the horizontal leg struck up from the horizontal leg.

13. A metal wall framing section as set forth in claim 9 wherein the stud members with the holes therein are arranged to constitute exterior stud members toward the side of the wall framing section on the outside of the building structure, and wherein the wall framing section has interior stud members located inwardly of and adjacent to the exterior stud members, said interior stud members terminating at lower ends thereof generally at the level of the upper edge of the vertical leg of the bottom member, said framing section further comprising an elongate foot extending across the interior stud members adjacent the lower ends of the interior stud members, said foot being fastened to the interior stud members.

14. A metal wall framing section as set forth in claim 13 wherein the foot is of L-shape in transverse cross section thereby having a vertical leg and a horizontal leg, the vertical leg of the foot being fastened to the interior stud members adjacent their lower ends and the horizontal leg of the foot extending in the direction away from the exterior stud members and overlying and fastened to the foundation structure.

15. The method of constructing a building comprising providing a metal wall framing section as set forth in claim 9, threading a reinforcing bar through the holes in the stud members of said metal wall framing section, erecting the section in situ, and pouring concrete around the lower ends of the stud members and the reinforcing bar utilizing the bottom member as a form to form a concrete foundation structure for the wall framing section, the concrete setting with the lower ends of the stud members and the reinforcing bar embedded therein.

16. The method of constructing a building comprising providing a metal wall framing section as set forth in claim 10, threading a first reinforcing bar through the holes in the stud members of said metal wall framing section, erecting the section in situ, placing a second reinforcing bar on the chairs of said section, and pouring concrete around the lower ends of the stud members and the reinforcing bar utilizing the bottom member as a form to form a concrete foundation structure for the wall framing section, the concrete setting with the lower ends of the stud members and the reinforcing bar embedded therein.

17. The method of constructing a building as set forth in claim 16 further comprising providing an auxiliary frame having a plurality of interior stud members extending parallel to one another spaced at intervals corresponding to the spacing of the first-mentioned stud members and each having a length corresponding generally to the distance measured vertically between the top member and the upper surface of the foundation structure, said auxiliary frame further comprising an elongate foot extending across the interior stud members adjacent their lower ends and fastened thereto, and wherein, after the concrete has set, the auxiliary frame is set in place extending vertically between the top member and the foundation structure with the upper ends of the interior stud members engaging the top member and the foot engaging the upper surface of the foundation structure, and fastening the interior stud members at their upper ends to the top member and fastening the foot to the foundation structure.

* * * * *